US005692241A

United States Patent [19]

Helfer

[11] Patent Number: 5,692,241

[45] Date of Patent: Dec. 2, 1997

[54] NECKTIE FORMING DEVICE

[76] Inventor: Matthew M. Helfer, 2225 Branner Ave.—Apt. #29, Jefferson City, Tenn. 37760

[21] Appl. No.: 629,027

[22] Filed: Apr. 8, 1996

[51] Int. Cl.[6] ..... A41D 25/08

[52] U.S. Cl. ..... 2/152.1; 2/148; 2/150; 2/153; 289/1.2; 289/1.5; 289/17

[58] Field of Search ..... 2/52, 144, 145, 2/146, 147, 148, 149, 150, 151, 152.1, 153; 223/81, 82, 83, 84; 289/1.2, 2, 1.5, 17, 18.1

[56] References Cited

U.S. PATENT DOCUMENTS

| | | | |
|---|---|---|---|
| 1,300,321 | 4/1919 | Wofford . | |
| 1,367,461 | 2/1921 | Caumont . | |
| 1,456,622 | 5/1923 | Crause . | |
| 2,269,769 | 1/1942 | Kennedy | 2/153 |
| 2,271,067 | 1/1942 | Fruns | 2/153 |
| 2,450,471 | 10/1948 | Dorkin | 2/153 |
| 3,756,638 | 9/1973 | Stockberger | 289/17 |
| 4,815,772 | 3/1989 | Lizarraga | 289/17 X |

*Primary Examiner*—Jeanette E. Chapman
*Attorney, Agent, or Firm*—Myers, Liniak & Berenato

[57] ABSTRACT

A necktie knot forming device is provided. The knot forming device is temporarily attached to the tie prior to forming the knot and retains the tie and the device in position during the knot formation process. Once the knot is substantially completely formed, the device is then removed from the tie and a neat, consistent, four-in-hand knot remains in the tie.

12 Claims, 2 Drawing Sheets

NECKTIE FORMING DEVICE

BACKGROUND OF THE INVENTION

The present invention relates to a necktie knot forming device. More particularly, the present invention relates to an improved removable necktie knot forming device that is simple, lightweight, durable and can be fully operated with one hand to form a perfect four-in-hand or other knot in a necktie every time. The necktie knot forming device of the present invention is equally beneficial as a training device to those that are learning how to tie a necktie, as well as to those that may have difficulty in consistently forming a neat knot in a tie.

The necktie has been a staple item in a mans dress wardrobe for many decades. However, since neckties are usually manufactured and sold in an untied state and worn in a knotted configuration, there have been problems associated with forming consistent, neat knots in neckties since such ties were first introduced. As expected, therefore, a number of solutions have been proposed to the knot forming problem. While some of these solutions have produced arguably satisfactory results, they frequently have been costly, expensive, cumbersome and complicated to use. As a result, such prior solutions have often introduced new complications and drawbacks that were more significant than the initial problem of knot formation that they attempted to solve. These proposed solutions were often of no value in teaching individuals how to form knots in ties. Likewise, the intricate pathway necessitated by many prior designs did not have any value to any user that was physically or mentally challenged or without the full use of both hands.

One of the earliest known devices designed to address the formation of knots in neckties was the clip-on tie. The clip-on tie featured a permanently tied necktie with a hook attached to the back of the knot and two finger like projections, one on either side of the knot designed to slip under the shirt collar of the wearer. Such ties have suffered from both structural limitations and a lack of social acceptance. To begin with, since the tie was basically only secured to the shirt by a single hanger or hook. Certain movements by the wearer could lead to the tie being dislodged from the shirt and falling completely off. Beyond that, depending upon the collar style of the shirt worn with the tie, it was frequently possible to see the finger-like projections of the tie under the collar or the hook behind the knot of the tie itself.

The readily recognizable structure of the clip-on tie often proved to be a source of embarrassment for the wearer, since, if detected, it amounted to an admission that one did not have sufficient knowledge to tie a knot. As a result, manufacturers severely limited the number of fabrics and styles that were produced in this configuration. Although the clip-on ties were frequently marketed for use by children, they provided only a temporary solution. As the boy moved into young adulthood, he generally would be expected to shed a clip-on tie in favor of a standard tie. However, since the knot of the clip-on tie was permanently tied, it provided no basis for learning how to form a knot in a standard tie.

Other solutions attempted to assist tie wearers in forming a knot in a standard tie. For example, U.S. Pat. No. 1,456,622 to Crause disclosed a necktie knot forming device. This device, however, was designed to have a standard tie tied around it and remain in that condition for a virtually unlimited time period. In effect, it turned the standard tie into a clip-on tie. The device was heavy and cumbersome due to its metal construction. It also required a great amount of dexterity to feed the tie through the aperture of the device to form a knot and also required attachment to the shirt by visible projections. Utilization of this device also could be quite expensive since it advocated the use of a new device for each and every tie that one owned so that they could be stored in a tied condition for ultimate use.

U.S. Pat. No. 1,367,461 to Caumont disclosed a similar necktie forming device. The sole purpose of this device was to enhance the appearance of the finished knot. The apertured center and metal wires of its construction again required a great deal of manual dexterity on the part of the user to form the knot on the device. This metal construction led to undue wear on the tie and discomfort for the wearer. Once formed, the device was potentially dangerous. Its wire and sheet metal construction ended up placed against the neck of the wearer since the device was required to remain in the formed knot the entire time that the user had the tie on. In addition, the metal wires intended to maintain the tie on the shirt collar, were potentially visible and rather unsightly.

U.S. Pat. No. 1,300,321 to Wofford, disclosed a necktie tying form that was designed to assist in forming a neat knot and minimize wrinkling of the tie during the tying process. This form, however, still required a great deal of manual dexterity to pass the tie through the small holes of the device in order to ultimately tie the tie. In addition, use of this device again required that it remain with the formed knot for the entire time that the tie was worn. This lead to potential wear on the tie and discomfort for the wearer.

Various other solutions were proposed to solve the problem making a knotted tie look neater. However, these solutions did not assist in formation of the basic knot and certainly did not have the ability to teach one that did not know how to knot the tie to do so. For example, U.S. Pat. No. 2,271,067 to Fruns disclosed a device for making the appearance of the finished knot better looking. The device is not utilized, however, until the knot on the tie is virtually entirely formed. This device further requires a fair amount of manual dexterity to operate it and must stay in place during the entire time that the user is wearing the knotted necktie.

Similarly, U.S. Pat. No. 2,450,471 to Dorkin, teaches a device to assist one tying a four-in-hand knot in a necktie to produce a fold or cleft immediately below the knot. This device presupposes that one already knows how to successfully form a neat four-in-hand knot and only attempts to assist the wearer in insuring that the finished tie will have a well defined fold or cleft beneath the knot.

It is therefore apparent that the need exists for a necktie knot forming device that is removable, lightweight, easy to use and can be equally utilized by those that do not yet know how to tie a tie equally as well as those with manual dexterity problems or those that for other reasons have trouble forming neat and consistent knots in their neckties.

SUMMARY OF THE INVENTION

It is therefore an object of the present invention to provide an improved necktie forming device that overcomes the drawbacks presented by prior art forming devices.

It is another object of the present invention a knot forming device that temporarily attaches to the tie during the formation of the knot and is thereafter removable, once the knot is correctly formed.

It is yet another object of the present invention to provide a small portable knot forming device that is easy to use and operate that can also be inexpensively manufactured and easily carried or stored.

It is a further object of the invention to provide a knot forming device that can be equally utilized by those that generally know how to form a four-in-hand knot, as well as those that do not.

It is an additional object of the present invention to provide a knot forming device that does not become part of the finished knot of the necktie and is easily removed after formation of the knot.

It is yet another object of the present invention to provide a knot forming device that is easy to understand and use and does not puncture the material of the tie at any time during its use, nor otherwise damage the tie in any way.

It is still another object of the present invention to provide a knot forming device that requires a minimum of manual dexterity to form a perfect four-in-hand knot and can be operated utilizing just one hand.

It is a still further object of the present invention to provide all of the above advantages in a device that minimizes wrinkling of the tie during the knot forming process and also forms neat and consistent four-in-hand knots.

It is another object of the present invention that, since it is removable, it does not show while wearing the knotted tie.

These and other objects of the present invention are met by a necktie forming device including a main body having a continuous aperture free surface and first and second open ends, means connected to the body for attaching the device to the necktie while the knot is being formed, and means connected to the body for removing the device from the necktie once the knot is formed, the removing means further being integral with the attaching means.

As a result of the construction of the present invention, it is equally beneficial to those that do not know how to tie a tie as a training tool and to those with either dexterity problems or other difficulties in forming neat, consistent knots in neckties.

BRIEF DESCRIPTION OF THE DRAWINGS

For a complete understanding of the nature and desired objects of this invention, reference should be made to the following detailed description, taken in connection with the accompanying drawings, wherein like reference numbers refer to corresponding parts throughout the several views of the preferred embodiments of the present invention and wherein.

DETAILED DESCRIPTION OF THE DRAWINGS

Figure 1:
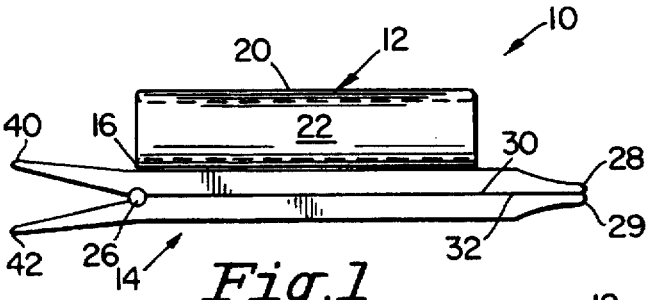
FIG. 1 is a side view of one embodiment of the present invention.
Figure 2:
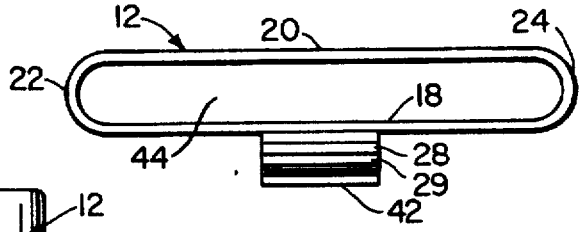
FIG. 2 is a top view of one embodiment of the present invention.
Figure 3:
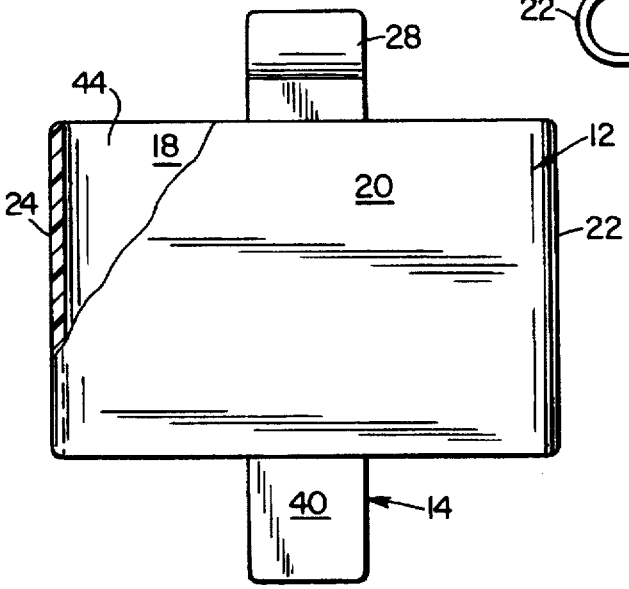
FIG. 3 is a front view of one embodiment of the present invention.

Referring now to the drawings and, in particular, FIGS. 1–4, a preferred embodiment of the necktie knot forming device of the present invention is generally referred to as 10. It should be understood that, although the present invention will be described in terms of a particularly preferred embodiment, this description is intended to be exemplary rather than limiting since the basic structure of the present invention can include various different modifications and variations without departing from the spirit and scope of the invention.

The knot forming device 10 generally consists of a body 12 that is connected to a fastening element 14. The body 12 features a smooth, continuous aperture free surface that defines an inner opening 44. The device does not, therefore, cause any undue wear on the tie. The body 12 can be constructed of a number of different materials, as long as the material is lightweight, strong and durable. It has been found that preferred materials meeting these requirements include most plastics and nylon. The body 12 and its opening 44 can be provided in a variety of different shapes including round, oval, triangular or square. In the illustrated embodiment, the body 12 features a back portion 18, opposite side portions 22 and 24 respectively and a front portion or bridge 20.

Although the bridge 20 can be constructed completely flat, it is most preferable that it has a slight angle on its surface. The opening 44 is designed to be long enough to accommodate a variety of different styles and widths in ties. Additionally, the opening 44 should be wide enough so as to require a minimum of dexterity in threading a tie through the opening, but not too large so as to use too much tie in forming a proper knot. The bridge is also large enough to provide a guide for wrapping the tie around the outer surface thereof. Unlike the prior art necktie formers, the present invention does not have any holes or slots in the surface of the body 12 that need to be navigated in order to complete the process of forming a knot in the tie. The slots and apertures in these prior art designs required a great deal of manual dexterity in order to move the tie through the intricate and precise path they created.

Although a variety of different sizes have been found to be acceptable, it has been found most preferable if the width of the bridge 20 is approximately 1 inch to 1¾ inches and about 2½ to 3¼ inches in length. Likewise, although many dimensions are acceptable, the short diameter of the opening (distance between the back 18 and the bridge 20) is usually most preferable at about ¾ inches to 1 inch.

As previously mentioned, the fastening element 14 is attached to the back 18 of the body 12. The fastening element 14 is designed to removably attach the device 10 to a necktie to allow the device 10 and the tie to be held in place during the forming of a knot in the tie. When initially attached to an unknotted tie, the fastening element 14 secures two parts of the tie in an overlapping manner. Once the knot is substantially completely formed, the fastening element 14 is then released to remove the device 10 from the tie and allow it to be tightened by pulling on either or both of the two ends of the tie.

The fastening element 14 can be formed out of the same material integrally with the body 12 or can be a separate component that is otherwise rigidly attached to the back 18 of the body 14. For example, the fastening element 14 could take the form of a separate spring clip that is glued or otherwise permanently attached to the surface of the body 12. Alternatively, an attachment mechanism such as a slot and detent combination can be used to removably attach the body 12 to the fastening element 14 in a manner that would allow interchangeability of various different body designs with a single fastening element 14.

Figure 4:
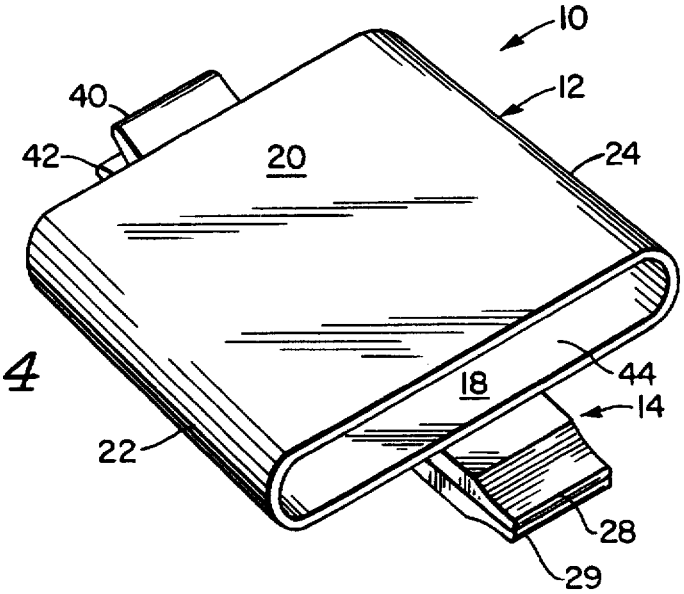
FIG. 4 is a perspective view of one embodiment of the present invention.

Turning now to a preferred fastening element particularly illustrated in FIGS. 1 and 4, the element 14 is illustrated as being rigidly attached to the back 18 of the body 12. The illustrated fastening element 14 takes the form of a clasp that holds what will ultimately be the front and back parts of the tie together before the knot is formed. The device 10 then remains in place without any assistance from the user until the knot is formed. At that point, it is then removed from the knotted tie. Both attachment and removal of the device 10 can be accomplished with one hand.

The shape and size of the illustrated fastening element 14 will offer the present invention further advantages. The bearing ends 28 and 29 of the element extend slightly above the top of the back 18 of the body 12. The ends 28 and 29 are also preferably rounded. In this manner, the ends 28 and 29 extend far enough above the back 18 so that the user can easily see them in order to facilitate clasping the fastening element 14 onto the tie. The fact that the ends 28 and 29 extend above the top of the back 18 of the body 12 also optimally positions the body 12 of the device 10 for subsequent proper knot formation. The rounding of the ends 28 and 29 insures that they do not become hazardous since they will be located near the throat area of the user during formation of the knot.

The fastening element 14 also features a spring mechanism 26 that serves to keep the ends 28 and 29 tensioned against each other so that the element 14 is fastened to the tie until it is desired to be removed. The tension on the mechanism is preferably sufficient to retain the device in place, but not to require an undue amount of pressure to open the ends 28 and 29 to attach and remove the device 10 from the tie. The levers 40 and 42 of the fastening element 14 extend sufficiently below the bottom of the back 18 of the body 12 and are wide enough to allow them to be easy to grasp and squeeze to initially attach the device and to remove it after the knot is formed in the tie. It has been found that it is most preferable if the element 14 extends about 1 inch from the bottom edge of the back of the body 12.

The operation of a preferred embodiment of the present invention will now be described with particular reference to FIGS. 5*a* through 5*d*.

Figure 5A:
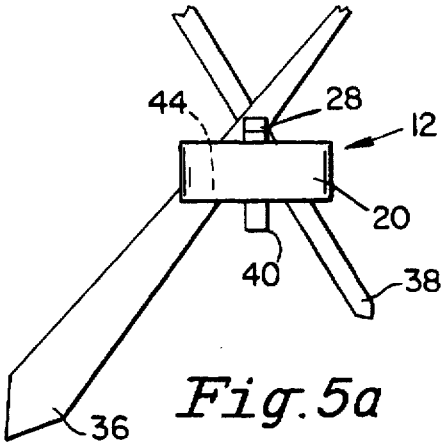
FIG. 5*a* is a schematic illustration of one embodiment of the present invention illustrating the first step in the formation of a necktie knot.

Referring to FIG. 5*a*, the tie is first placed around the collar of the wearer with the front or leading end 36 crossed over the back or trailing end 38. The device 10 is then moved into place and temporarily fastened onto the tie at the point where the tie overlaps itself. Attachment of the device is attached by grasping the levers 40 and 42 of the fastening element 14 until the bearing ends separate far enough for them to accommodate the material where the tie 34 overlaps. The tension on the levers 40 and 42 is then released to allow the bearing surfaces 30 and 32 to clasp the tie 34 and thereby attach the device 10 to the tie while also retaining the tie 34 in position. As illustrated in FIG. 5*b*, the leading end 36 of the tie 34 is then passed behind the device 10 at the point where the tie 34 is attached to the bearing ends 28 and 29 of the fastening element 14. Next, as illustrated in FIG. 5*c*, the leading end 36 of the tie 34 is then laid over the entire surface of the bridge 20 of the body 12.

Figure 5D:
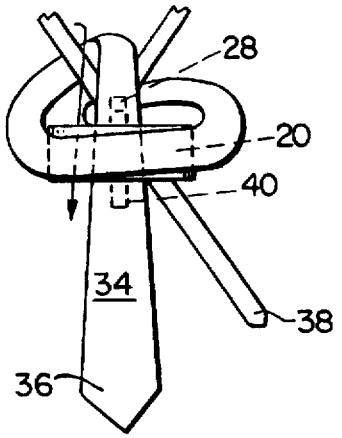
FIG. 5*d* is a view similar to FIG. 5*c* showing the fourth step in the necktie knot formation.
Figure 5B:
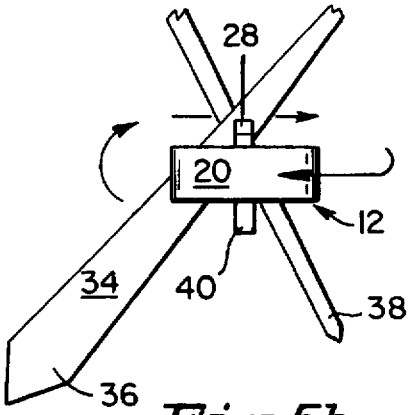
FIG. 5*b* is a view similar to FIG. 5*a* showing the second step in the necktie knot formation.
Figure 5E:
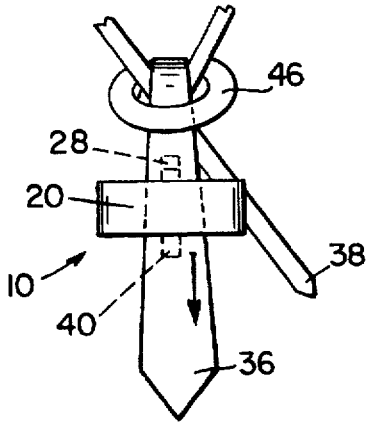
FIG. 5*e* is a view similar to FIG. 5*d* illustrating the last step in the formation of a necktie knot using the present invention and removal of the device.
Figure 5C:
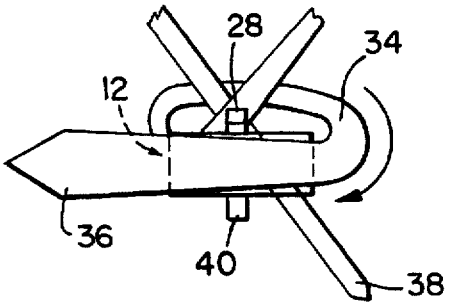
FIG. 5*c* is a view similar to FIG. 5*b* showing the third step in the necktie knot formation.
Figure 5F:
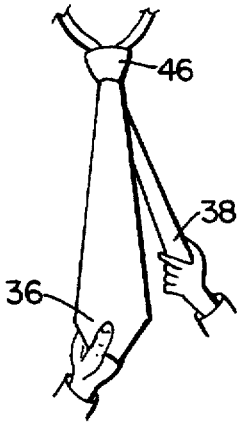
FIG. 5*f* is a schematic view similar to FIG. 5*e* with the knot completely formed in the necktie.

As illustrated in FIG. 5*d*, the leading end 36 of the tie 34 is then passed over the top of the bearing ends 28 and 29 and completely through the opening 44 of the body 12. As illustrated in FIG. 5*e*, at this point the knot 46 is formed and the fastening element 14 can be unclasped. The device 10 is removed from the tie 34 by grasping the levers 40 and 42 to separate the ends 28 and 29 and pulling it downwardly away from the knot 46. The knot 46 can then be tightened by pulling the front end 36 downwardly away from the knot 46. Although not required, it is preferable that while one is pulling on the front end 36 of the tie 34, that individual also hold the back end 38 of the tie in place.

As can be appreciated, the device 10 of the present invention allows consistent formation of a perfect four-in-hand knot. In addition, the device is removable so it does not wear on the fabric of the tie, nor does it create a bulky or uncomfortable attachment at the point of the knot into the wearers throat. The device 10 can be utilized with just one free hand and functions as a learning aid for one that does not know how to tie a tie to ultimately acquire the skill without the use of the device, by allowing the user to visually see all of the steps required to form the knot which would need to be replicated if one were to do so without the device 10.

From the foregoing, it can bee seen that the necktie knot forming device of the present invention provides a significant improvement compared to prior art designs.

Having thus described my invention, I claim:

1. A selectively removable device for teaching one to form a knot in a necktie, comprising:

a closed aperture free main body with first and second open ends;

said main body having a non-adjustable continuous inner surface of a constant diameter;

means connected to said body for attaching said device to the necktie while the knot is being tied therein and for selectively removing said device from said necktie when a knot is substantially completely formed therein; and a portion of said attaching and removing means being unitary with said body and formed out of the same material.

2. The device of claim 1 wherein said main body is in the shape of an oval.

3. The device of claim 1 wherein said main body is round.

4. The device of claim 1 wherein said main body is triangular.

5. The device of claim 1 wherein said main body is square shaped.

6. The device of claim 1 wherein said main body further comprises:

a back;

first and second sides; and a front, wherein said front is angled between its center and said first and second sides.

7. The device of claim 1 further comprising a spring mechanism located in said attaching and removing means.

8. A selectively removable necktie knot forming device comprising:

a closed substantially rigid aperture flee main body with first and second open ends;

said main body having a non-adjustable continuous inner surface of a constant diameter, a front portion and a back portion, said body further having a first projection integral with and extending outwardly from said main body and said first projection being substantially perpendicular to said second end of said main body and including a first necktie engaging surface;

a lever arm pivotally connected to said front portion of said main body, said lever arm including a second necktie engaging surface opposing said first necktie engaging surface of said first projection; and means for contacting a portion of said lever arm and for urging said second engaging surface of said lever arm into contact with said first engaging surface of said first projection.

9. The device of claim 8 wherein said contacting means is integral with said main body.

10. The device of claim 8 having a second projection integral with said back portion of said main body, said second projection extending outwardly away from said main body in a direction opposite to said first projection.

11. A method of forming a knot in a necktie having first and second ends comprising the steps of:

providing a selectively removable necktie knot forming device having a main body with a continuous substantially rigid aperture free surface with front and back portions and first and second open ends, a selectively releasable means for attaching said device to a necktie having a first necktie engaging surface projecting outwardly and integral with said main body and a second necktie engaging surface opposite said first necktie engaging surface;

overlapping one portion of said necktie over a second portion thereof, attaching said necktie forming device at the point where said necktie overlaps itself with said first and second necktie engaging surfaces in contact with said necktie, passing said first end of said necktie around a portion of said knot forming device between said first and second ends thereof;

passing said first end of said necktie through said first open end and then said second open end of said main body;

removing said device from said necktie by moving said first and second engaging surfaces away from said surface of said tie; and tightening said knot in the necktie by pulling on said first and second ends of the necktie.

12. The device of claim 8, wherein said lever arm is selectively removable from said main body.

* * * * *